United States Patent [19]

Spriggs et al.

[11] Patent Number: 4,637,469

[45] Date of Patent: Jan. 20, 1987

[54] APPARATUS AND METHOD OF WELL PREPARATION FOR CHEMICAL TREATMENT OF PRODUCED FLUIDS

[75] Inventors: Dennis M. Spriggs, Dallas; Jody R. McGlothen, Garland, both of Tex.

[73] Assignee: Dresser Industries, Inc., Dallas, Tex.

[21] Appl. No.: 637,671

[22] Filed: Aug. 6, 1984

[51] Int. Cl.[4] ..... E21B 41/02; E21B 23/04

[52] U.S. Cl. ..... 166/310; 166/72; 166/212; 166/217; 166/382; 166/902

[58] Field of Search ..... 166/310, 68, 105, 106, 166/114, 138, 244 C, 179, 120, 72, 212, 217, 382, 304, 371, 375, 902

[56] References Cited

U.S. PATENT DOCUMENTS

| | | | |
|---|---|---|---|
| 2,552,153 | 5/1951 | Crake | 166/212 |
| 2,658,459 | 11/1953 | Page | 166/212 |
| 2,735,497 | 2/1956 | Brumleu et al. | 166/212 |
| 3,380,531 | 4/1968 | McAuliffe et al. | 166/371 |
| 3,455,394 | 7/1969 | Knight | 166/371 |
| 3,456,723 | 7/1969 | Current et al. | 166/120 |
| 3,467,184 | 9/1969 | Young | 166/129 |
| 3,548,946 | 12/1970 | Engle | 166/310 |
| 3,625,281 | 12/1971 | Herd et al. | 166/0.6 |
| 3,643,737 | 2/1972 | Current et al. | 166/216 |
| 3,861,471 | 1/1975 | Douglas | 166/314 |
| 4,189,001 | 2/1980 | Greenlee | 166/216 |
| 4,349,071 | 9/1982 | Fish | 166/124 |
| 4,387,767 | 6/1983 | Read | 166/72 |
| 4,423,777 | 1/1984 | Mullins et al. | 166/217 |

*Primary Examiner*—George A. Suchfield
*Assistant Examiner*—Bruce Kisliuk

[57] ABSTRACT

An apparatus for chemical treatment of a fluid pumped from a well through a production tubing includes a tubing anchor with slips adapted to be set hydraulically and mechanically against the casing in the well without rotating the production tubing. A branch line from a chemical injection line communicates with a setting pressure chamber in the anchor which, when pressurized, is used to initially set the slips. Thereafter, a straight pull on the tubing mechanically completes setting of the slips and a plug blocking the injection line is removed enabling the delivery of a treatment chemical to the well fluid upstream of a pump utilized in removing the fluid in the well.

18 Claims, 8 Drawing Figures

FIG. 3a
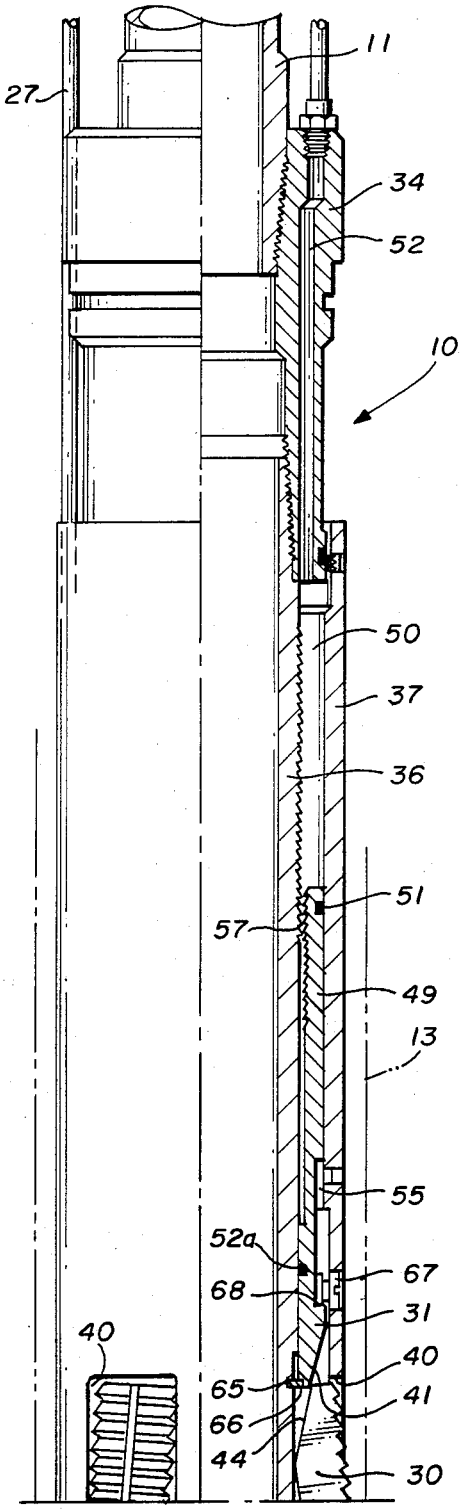
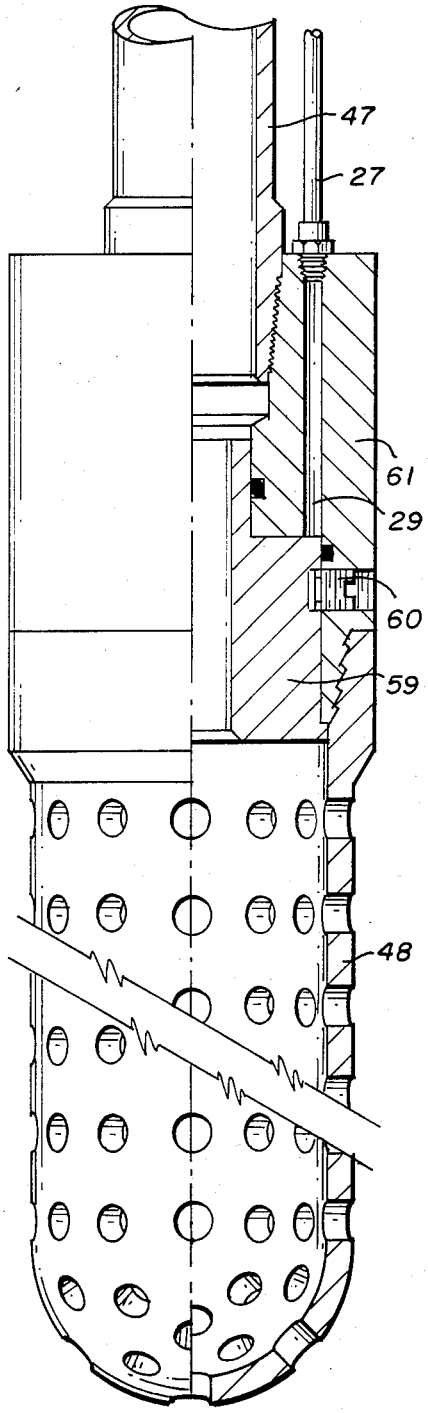
FIG. 1c

APPARATUS AND METHOD OF WELL PREPARATION FOR CHEMICAL TREATMENT OF PRODUCED FLUIDS

TECHNICAL FIELD

This invention relates to apparatus for use in a production well of an oil field being produced through the use of secondary oil recovery techniques.

BACKGROUND ART

In one form of secondary or enhanced oil recovery carbon dioxide gas is forced through a number of injection wells into an oil bearing formation causing oil in the formation to migrate toward and collect in a production well. In recovering the oil collected in the production well a sucker rod pump or the like may be used. Such a pump typically is mounted within a string of production tubing extending into the oil at the bottom of the well and includes a series of one-way check valve structures located downhole below the level of oil collected in the well. One of the valves, the traveling valve, is located at the bottom of a lifting chamber carried on the lower end of the sucker rod and allows oil to flow into the chamber with each down stroke of the rod. The other valve, the fixed valve, is located below the traveling valve and allows oil to flow one-way into an inlet chamber thereabove from a collection chamber at the bottom of the tubing string. Accordingly, with each up stroke of the sucker rod, oil flows into tubing past the fixed valve as the oil above the traveling valve is lifted through the tubing toward the surface. On the down stroke, the oil in the inlet chamber above the fixed valve flows past the traveling valve into the lifting chamber with the fixed valve preventing the oil from flowing reversely from the inlet chamber into the collection chamber and back toward the formation.

To support the tubing string downhole against movement in rhythm with the reciprocating action of the sucker rod, a tubing anchor may be used in proximity of the traveling valve. Preferably, the anchor is secured to the well casing such as by means of slips with the tubing string in tension. This helps keep the tubing from buckling on the up stroke of the pump rod so as to avoid potential wear between the rod and the inside of the tubing.

Unfortunately, the use of carbon dioxide in secondary recovery can have a very corrosive effect upon the tubing and pump apparatus with which the produced oil in the production well comes into contact as the oil is being pumped toward the surface. To neutralize the corrosive effects of the carbon dioxide, an amine compound may be injected into the oil and, it is desirable that such anti-corrosive chemical be added to the oil in the vicinity of the pump inlet so that the chemical is drawn into and mixed with the oil being pumped upwardly as an incident to the reciprocating action of the sucker rod. In this way, the chemical is concentrated for use in the area where it is most needed so as to avoid having to use excessive quantities. One way of providing the chemical at the pump inlet is through the use of a separate chemical delivery line secured to the outside of the tubing string and leading from a supply source at the top of the well to an outlet port opening into the collection chamber in the well just beneath the fixed valve.

DISCLOSURE OF THE INVENTION

The present invention contemplates an improvement in the foregoing described apparatus to provide for setting of the tubing anchor without fouling of the chemical injection line. More specifically, the present invention provides an unique combination of well apparatus including the sucker rod pump, separate chemical line and tubing anchor adapted to be set within the well casing without the need for rotation of the tubing.

The invention also resides in the novel construction of the tubing anchor to provide for setting of slips in the anchor through the use of hydraulic pressure and, particularly hydraulic pressure provided through the injection line and normally sealed against communication with the inside of the string of production tubing.

Still further, invention resides in a novel method of preparing a production well to offset the corrosive effects of carbon dioxide injection while still providing for spotting of anti-corrosive chemicals without fouling of the chemical injection line during setting of a tubing anchor.

These and other advantages and structural features of the present invention will become more apparent from the following description of the best mode of carrying out the invention when taken in conjunction with the accompanying drawings.

BRIEF DESCRIPTION OF THE DRAWINGS

FIGS. 1*a*, 1*b* and 1*c* are combined elevational and cross-sectional views of a combination of well tools embodying the novel features of the present invention.

FIGS. 3*a* and 3*b* are views similar to FIGS. 2*a* and 2*b* but showing parts of the well tools in still further moved positions.

BEST MODE OF CARRYING OUT THE INVENTION

Figure 2A:
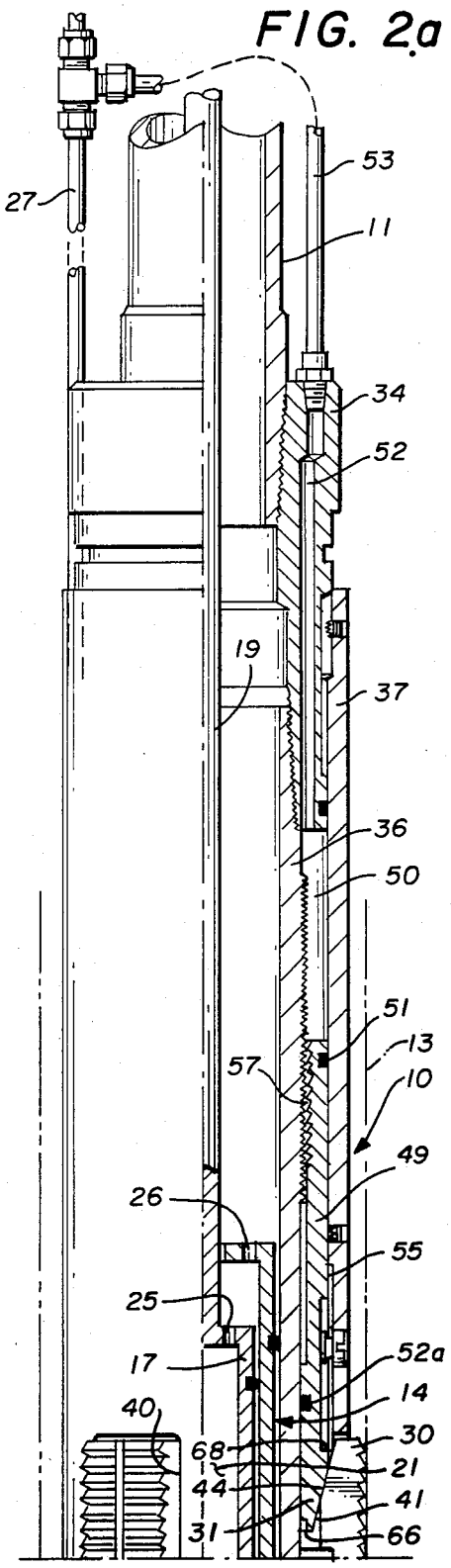
FIGS. 2*a*, 2*b* and 2*c* are views similar to FIGS. 1*a*, 1*b* and 1*c* but showing parts of the well tools in moved positions.
Figure 1B:
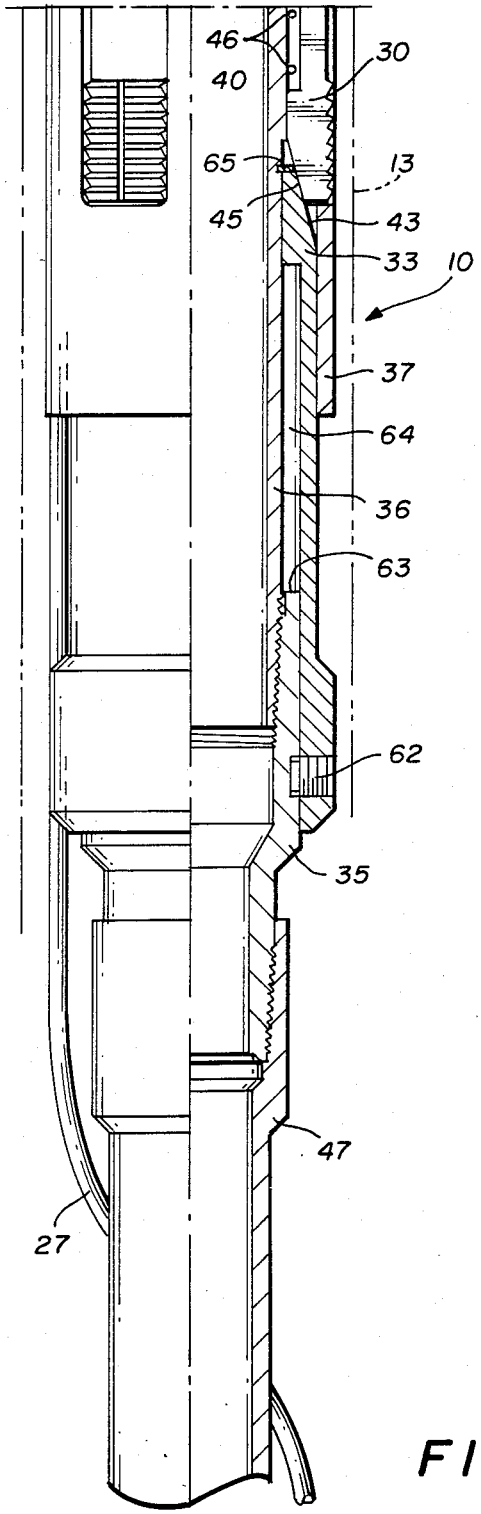
Figure 2B:
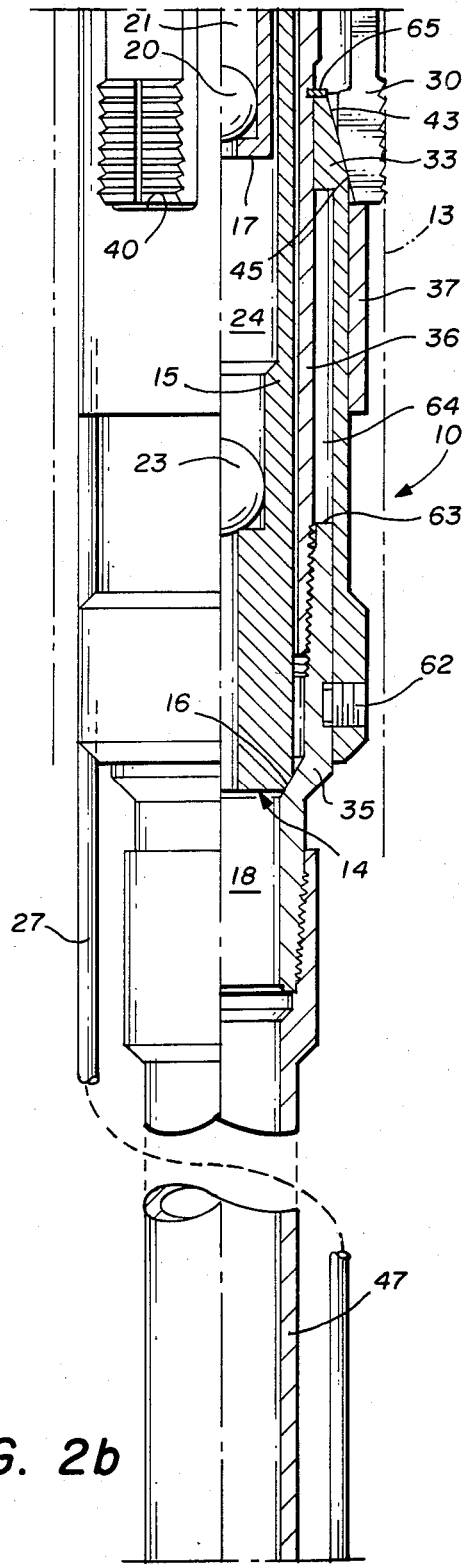

As shown in the drawings for purposes of illustration, the present invention is embodied in a tubing anchor 10 particularly adapted to secure the lower end of a string of tubing 11 to the casing 13 of a well as an aid to the recovery of oil from the well by an artificial lift process. As shown in FIGS. 2*a* and 2*b*, the lift process contemplates the use of a pump 14 including a housing 15 which is seated against a shoulder 16 in the tubing anchor. More specifically, the pump includes a reciprocal plunger 17 connected by means a rod 19 to the surface of the well. Within the lower end of the plunger is a traveling valve 20 which functions as a one-way check valve allowing flow upwardly into a lifting chamber 21 of the plunger with each downward stroke of the rod 19 but preventing the flow of fluid downwardly out of the plunger when the latter is lifted within the housing 15. Within the lower end of the housing, a fixed valve 23 provides a second one-way check valve function, allowing well fluids to flow inwardly into an inlet chamber 24 of the pump housing 15 from a collection chamber 18 as the plunger 17 is lifted but preventing the flow of fluid in the inlet chamber 24 from flowing downwardly out of the housing into the collection chamber as the plunger is lowered. As may be seen in FIG. 2*a*, the plunger is sealed within the housing, and the housing in turn, is sealed within the tubing anchor 10. The plunger and housing include exit ports 25 and 26, respectfully, to allow the reciprocating action of the plunger to pump the fluid collected in the well upwardly from the inlet chamber 24 through the lifting chamber 21 and ultimately into the tubing 11 to be delivered to the surface of the well.

The tubing anchor 10 serves to secure the lower end of the tubing 11 within the well so that the reciprocating action of the pump 14 does not cause the tubing to expand and contract in length as the plunger 17 is reciprocated. Preferably, this is accomplished when setting the anchor with the tubing being left in tension. Thus the tubing is held as straight as possible so that upward movement of the plunger by pulling on the rod 19 does cause the tubing 11 to tend to contract and cork screw slightly within the casing. Experience has shown that cork screwing of the tubing can result in the rod wearing against the inside of the tubing during pumping.

Figure 2C:
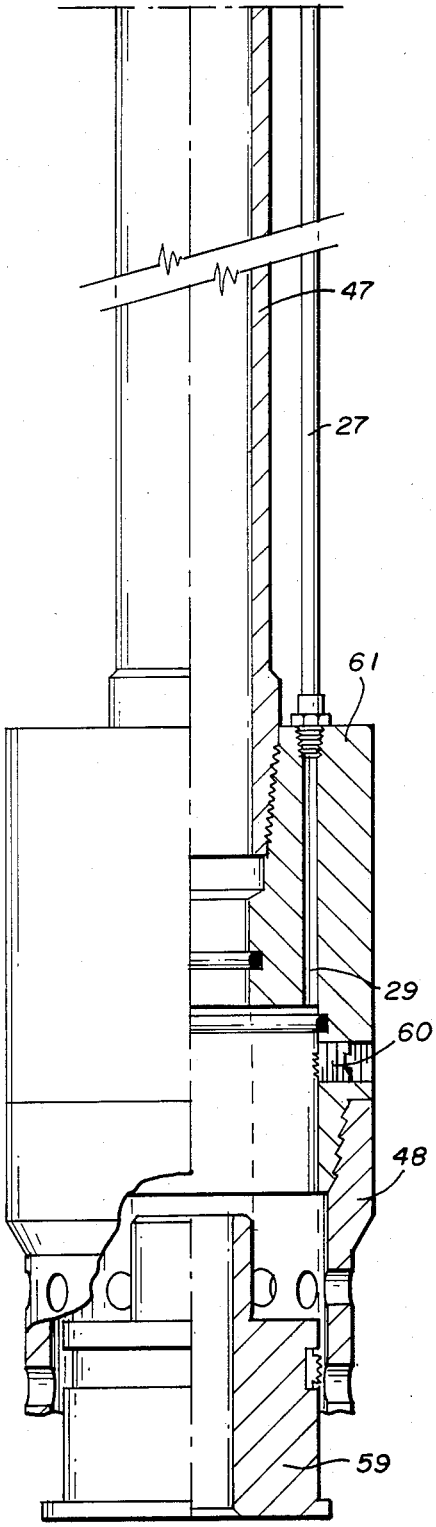

When the pump 14 is used within a production well stimulated by surrounding wells injected with carbon dioxide, it is desirable that a chemical such as an amine compound be injected into the well fluid below the pump so as to neutralize the corrosive effects of the carbon dioxide on the metal parts of the pump coming into contact with the fluid being produced. In order to direct the anti-corrosive chemical into the well fluid beneath the fixed valve 23, a separate small tubing or injection chemical line 27 is attached to and run into the well with the tubing 11. An outlet 29 (see FIGS. 2*b* and 2*c*) of the injection line is located beneath the fixed valve 23 so that the chemical can be injected into the well to mix with the well fluid as the latter is drawn through the valve 23 with each upward stroke of the plunger 17.

In accordance with an important aspect of the present invention, slips 30 for securing the anchor 10 to the casing 13 are set without the need for rotation of the tubing 11 so as to avoid fouling of the injection chemical line 27. Herein, this is achieved through the use of setting pressure communicated to an upper setting head 31 (see FIG. 1*a*) of the tubing anchor 10 to cause initial engagement of the slips 30 with the casing. Thereafter, an upward pull on the tubing 11 completes setting of the slips with a lower setting head 33 wedging the slips 30 radially outward to embed within the casing. Advantageously, the pressure for initiating the setting of the slips is delivered through the injection chemical line 27 with the moveable parts of the tubing anchor sealed against communication with the well fluids so as to reduce the potential corrosive effects of the well fluids on the working parts of the tubing anchor.

In the present instance, the tubing anchor 10 includes upper and lower connectors 34 and 35 separated by a tubular mandrel 36. The upper connector is for connection to an upper portion of the tubing 11 while the lower connector 35 connects with a depending length of tubing 47 leading to a perforated nipple 48 protecting the open lower end of the tubing section 47 (see FIG. 1*c*). Surrounding the mandrel is a tubular anchor cage 37 whose upper end portion is secured to the upper connector by angularly spaced shear screws 39 (see FIG. 1*a*). In the intermediate portion of the anchor cage 37 between the connectors 34 and 35, are three angularly-spaced slip openings 40 through which the slips 30 are mounted for radial movement outwardly to embed in the casing 13. The upper and lower setting heads 31 and 33 are located between the anchor cage and mandrel radially inward of the slip openings 40 and include diverging frustoconical surfaces 41 and 43, respectively, for engagement by upper and lower wedging surfaces 44 and 45 of the slips 30. Annular coiled retaining springs 46 connected to the inside surfaces of the slips serve to hold the slips radially inwardly during movement of the tubing within the well casing.

Figure 1A:
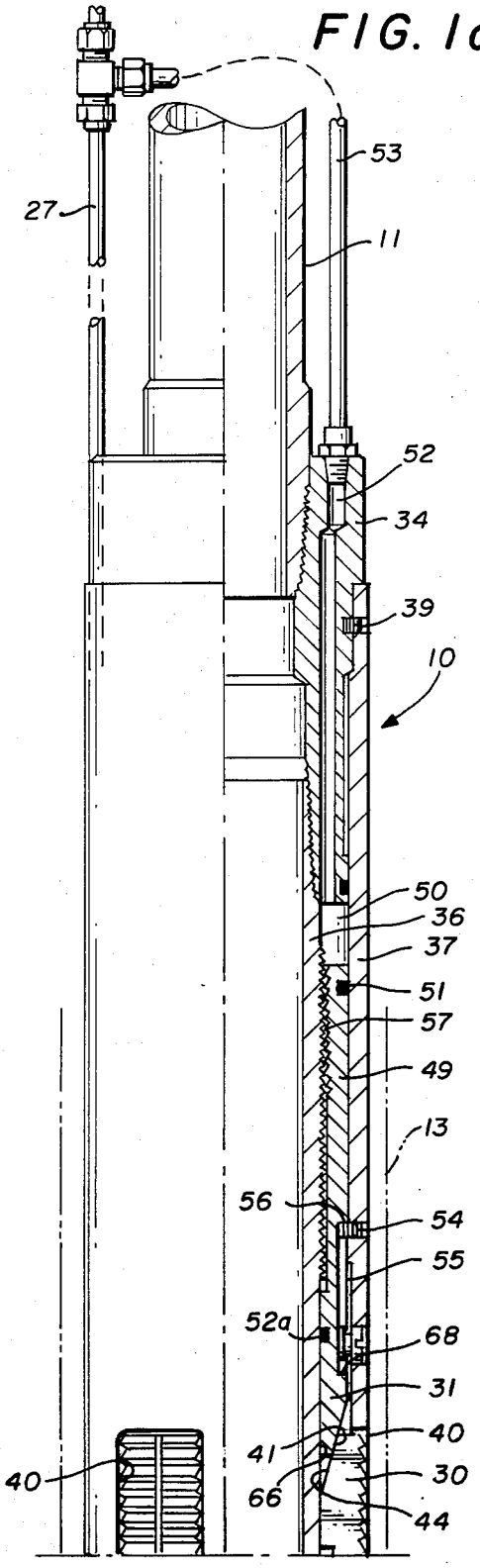

For setting the slips 30, the upper setting head 31 is formed on the lower end of an annular setting piston 49 located in the space between the upper portion of the anchor cage 37 and the mandrel 36. A setting pressure chamber 50 is defined above the piston between the cage and mandrel and is substantially sealed against fluid communication with the inside of the tubing. The outward surface of the piston 49 is sealed against the inside of the anchor cage by an O-ring seal 51 and similarly, the lower end portion of the inside of the piston is sealed by O-ring seal 52*a* against the mandrel 36. Communicating with the pressure chamber 50 is a branch line 53 connected between the injection chemical line 27 and a passage 52 extending through the upper connector 34. As shown in FIG. 1*a*, light pressure shear screw 54 is connected between the anchor cage 37 and the setting piston 49 to hold the latter against movement from any pressure head existing in the chamber 50 from the chemical injection line 27. Specifically, the shear screw 54 extends radially inward from the cage into a longitudinal slot 55 in the outer surface of the piston and normally abuts the upper end 56 of the slot to support the piston in its uppermost position for lowering of the tubing anchor on the tubing 11 into the well.

Once the anchor is located at the position desired within the well, pressure may be pumped into the injection chemical line 27 and through the branch line 53 shearing the screw 54 and causing the upper setting head 31 to slide downwardly underneath the wedging surfaces 44 of the slips 30 so as to force the upper end portions of the slips radially outward into engagement with the casing 13. One-way locking means in the form of a latch collar mechanism 57 located between toothed surfaces on the inner side surface of the piston 49 and outer side surface of the mandrel 36 serves to hold the upper setting head against movement upwardly relative to the mandrel yet allowing the mandrel td be moved upwardly relative to the upper setting head. With the upper teeth of the slips 30 biting into the inside surface of the casing 13, the tubing 11 may then be pulled upwardly to cause the lower setting head 33 to wedge beneath the lower wedging surfaces 43 of the slips 30 and thus completely set the slips 30 against the casing. As this occurs, the bottoms of the slip openings 40 engage the lower ends of the slips 30 and relative movement occurs between the anchor cage and the mandrel 36 with the mandrel 36 moving upwardly so that the screws 39 connecting the upper end of the anchor cage 37 to the upper connector 34 also are sheared. This allows the mandrel 36 to be pulled upwardly relative to both the piston 49 and the anchor cage 37 so as to tightly set the slips in the casing.

Thus, briefly in summary, the setting sequence involves pressurization of the injection chemical line 27 to shift the setting piston 49 downwardly and cock the upper ends of the slips 30 outwardly to embed in the casing. Thereafter, tension pulled in the tubing string 11 wedges the lower setting head 33 upwardly underneath the lower ends of the slips 30 causing the latter to move radially outward and embed in the casing. Coincident therewith, the screws 39 are sheared disconnecting the upper end of the anchor cage 37 from the upper connector 34.

Advantageously, in order to readily pressurize the injection chemical line 27 for setting of the slips 30, the outlet 29 of the injection line is blocked by a capping piston 59 (see FIG. 1*c*) normally held in a position closing the outlet 29 by means of a shear pin 60. Herein, the capping piston 59 is located within a outlet sub 61 mounted between the depending tubing section 47 and the perforated nipple 48. During the setting procedure, pressure in the injection chemical line 27 is pumped sufficiently high so that the pressure in the branch line 53 shifts the piston 49 causing the setting head 31 to wedge the slips 30 outwardly. Once the slips are completely set by pulling on the tubing, the pressure in the injection line 27 is pumped to a higher pressure causing the pin 60 to shear and the piston 59 to shift downwardly (see FIG. 2*c*) into the perforated nipple 48 thereby opening the outlet 29 for chemical to be drawn from the injection line 27 and into the well fluid during pumping.

Figure 3B:
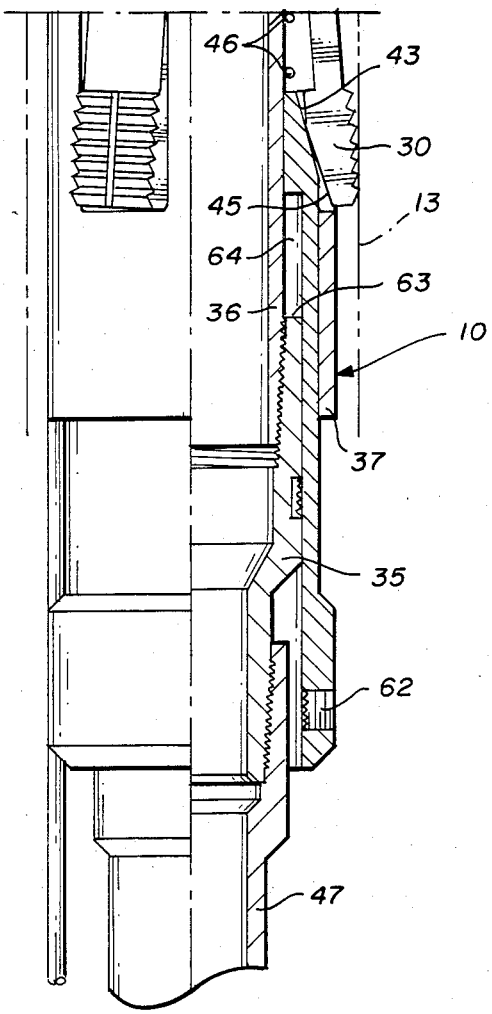

For retrieving the tubing 11 and tubing anchor 10 from the well after being set, means are provided in the anchor conditioning the anchor to be retrieved by a straight pull of the tubing string. Herein, such means includes a retrieval shear screw 62 (FIG. 2*b*) normally holding the lower connector 35 to the lower setting head 33. When the screw 62 is sheared by a strong upward pull on the tubing string, the mandrel 36 and lower connector slide upwardly within the lower setting head 33 and an upper shoulder 63 on the lower connector rides upwardly within a recess 64 in the lower setting head. On the mandrel above the shoulder 63, a retrieving ring 65 also is carried upwardly into abutting engagement with the lower end of the upper setting head 31, resting within a notch 66 (compare FIGS. 2*a* and 2*b* with FIGS. 3*a* and 3*b*). Further upward movement of the mandrel by pulling on the tubing string then lifts the upper setting head from beneath the upper end portion of the slips 30 so that the springs 46 pull the upper ends of the slips radially inward into a cocked position as shown in FIGS. 3*a* and 3*b*. As the upper setting head slides upwardly relative to the anchor cage 37, the lower end 68 of the longitudinal slot 55 in the piston 49 abuts against a gudgeon 67 extending inwardly from the anchor cage there by lifting the anchor cage and causing the lower ends of the slip openings 40 to abut and lift the lower ends of the slips 30 off the lower setting head wedging surfaces 43. As a result, the springs 46 complete pulling the slips 30 back into their radially inward positions. And the anchor 10 is then free to be pulled upwardly with the tubing string and retrieved from the well.

From the foregoing, it will be appreciated that the present invention brings to the art, a new and improved arrangement for securing the tubing anchor 10 to the well casing 13 without need for rotation of the tubing 11 to set the slips 30 and while still substantially isolating the working parts of the anchor from the corrosive effects of the well fluids. To this end, the slips 30 are set initially utilizing pressure delivered to the pressure setting chamber 50 through the branch line 53 and are then fully set mechanically by a straight pull of the tubing string.

The embodiments of the invention in which an exclusive property of privilege is claimed are defined as follows:

1. Apparatus for use on the lower end portion of a string of tubing located in the casing of a production well for chemical treatment of fluid pumped from the well through the tubing, comprising a tubing anchor having:

a tubular mandrel with upper and lower connectors adapted for connection within the tubing string, a tubular anchor cage concentrically spaced around said mandrel and connected to one of said connectors, a plurality of slips angularly spaced from each other around said mandrel within said cage and being movable radially outward thereof to embed in the casing.

first and second spaced setting heads connected to said mandrel between said connectors with said slips being disposed between said setting heads and including axially spaced wedging surfaces, pump means supported by said tubing for pumping fluid from the well upwardly through the mandrel and the tubing, a collection chamber beneath said pump means and communicating therewith to receive the well fluid to be pumped upwardly through the tubing, a chemical injection line connected to the outside of said tubing and including a lower outlet and adapted for communication with said collection chamber for injection of a treatment chemical into the well fluid before the latter passes through said pump, and means associated with said setting heads for moving said wedging surfaces toward each other without tubing rotation to wedge against and drive said slips radially outwardly to embed within the casing in the well, said means including means for pumping a pressure fluid through said chemical injection line to set said slips.

2. An apparatus as defined by claim 1 including retrieval means releasably connected between said mandrel and said anchor cage for unsetting said slips for said apparatus to be removed from the well with the tubing string.

3. Apparatus for use on the lower end portion of a string of tubing located in the casing of a production well for chemical treatment of fluid pumped from the well through the tubing, comprising a tubing anchor having:

a tubular mandrel with upper and lower connectors adapted for connection within the tubing string, a tubular anchor cage concentrically spaced around said mandrel and connected to one of said connectors, a plurality of slips angularly spaced from each other around said mandrel within said cage and being movable radially outward thereof to embed in the casing, first and second spaced setting heads connected to said mandrel between said connectors with said slips being disposed between said setting heads and including axially spaced wedging surfaces, means associated with said setting heads for moving said wedging surfaces toward each other without tubing rotation to wedge against and drive said slips radially outwardly to embed within the casing in the well, pump means supported by said tubing for pumping fluid from the well upwardly through the mandrel and the tubing, a collection chamber beneath said pump means and communicating therewith to receive the well fluid to be pumped upwardly through the tubing, a chemical injection line connected to the outside of said tubing and including a lower outlet end adapted for communication with said collection chamber for injection of a treatment chemical into the well fluid passes through said pump, and said means associated with said setting heads including a setting pressure chamber defined between said anchor cage and said mandrel, a setting piston connected with said first setting head for moving said first setting head upon the introduction of a pressure fluid into said pressure chamber, and a line section communicating with said injection line and said pressure chamber for delivering said pressure fluid to said chamber for setting said slips.

4. An apparatus as defined by claim 3 including one-way locking means connectable between said mandrel and said first head for permitting one-way relative movement between said first head and said mandrel in direction toward setting of said slips.

5. An apparatus as defined by claim 4 including retrieval means releasably connectable between said mandrel and said anchor cage for unsetting said slips for said apparatus to be removed from the well with the tubing string.

6. An apparatus as defined by claim 5 wherein said retrieval means comprises a first shear screw yieldably connecting together said mandrel and said second setting head and a lifting shoulder abuttable between said mandrel and said first setting head after shearing of said screw upon pulling of said tubing string to lift said first setting head from beneath said slips for unsetting of said slips.

7. An apparatus as defined by claim 6 including a slide connection between said mandrel and said slips for abutting lifting engagement therebetween after retraction of said one setting head so as to lift said slips from said other setting head as said tubing string is lifted and thereby complete unsetting of said slips.

8. An apparatus as defined by claim 7 wherein said slide connection includes an elongated slot in said anchor cage or said first setting head and a lifting gudgeon in the other of said anchor cage or said first setting head, said lifting gudgeon extending into said slot for abutting lifting engagement between said one end of said slot and said gudgeon when said first setting head is moved from beneath said slips during retrieving, and a lifting shoulder on said anchor cage to abut with and lift said slips from wedging engagement with said second setting head to complete unsetting of said slips as said tubing string is lifted.

9. An apparatus as defined by claim 3 including plug means for removably blocking said chemical injection line down stream of said branch line.

10. An apparatus as defined by claim 9 wherein said plug means comprises a sealed piston removably blocking said outlet from communication with said collection chamber and a second shear screw supporting said piston within said collection chamber and shearable upon pressurization of said injection line to a selected high pressure to shift said piston away from blocking said outlet.

11. An apparatus as defined by claim 3 including means normally sealing said setting pressure chamber against fluid communication with the inside of said tubing, a shear pin connected with said setting piston and supporting said setting piston in a retracted position, said shear pin being sheared by said setting piston upon pressurization of said setting pressure chamber to a selected setting pressure to move said one setting head in initially setting said slips.

12. An apparatus as defined by claim 11 including a second shear pin connected between said anchor cage and said mandrel and frangibly securing said anchor cage against movement relative thereto, said second setting head being tightly wedged beneath said slips by pulling on said tubing string after pressurization of said setting chamber and said second shear pin being sheared as an incident to pulling of said second setting head beneath said slips thereby enabling relative movement between said anchor cage and said mandrel for complete setting of said slips.

13. Apparatus for use on the lower end portion of a string of tubing located in the casing of a production well for chemical treatment of fluid pumped from the well through the tubing, comprising a tubing anchor having, a tubular mandrel with upper and lower connector adapted for connection within the tubing string, a tubular anchor cage concentrically spaced around said mandrel and connected to one of said connectors, a plurality of slips angularly spaced from each other around said mandrel within said cage and being movable radially outward thereof to embed in the casing, first and second spaced setting heads connected to said mandrel between said connectors with said slips being disposed between said setting heads and including axially spaced wedging surfaces, means associated with said setting heads for moving said wedging surfaces toward each other without tubing rotation to wedge against and drive said slips radially outwardly to embed within the casing in the well, pump means supported by said tubing for pumping fluid from the well upwardly through the mandrel and the tubing, a collection chamber beneath said pump means and communicating therewith to receive the well fluid to be pumped upwardly through the tubing, a chemical injection line connected to the outside of said tubing and including a lower outlet end adapted for communication with said collection chamber for injection of a treatment chemical into the well fluid before the latter passes through said pump, said means associated with said setting heads including a setting pressure chamber defined between said anchor cage and said mandrel, means normally sealing said setting pressure chamber against fluid communication with the inside of said tubing, a setting piston connected with said first setting head for moving said first setting head upon the introduction of a pressure fluid into said pressure chamber, and a branch line communicating between said injection line and said pressure chamber for delivering said pressure fluid to said chamber for setting said slips, retrieval means releasably connectable between said mandrel and said anchor cage for unsetting said slips for said apparatus to be removed from the well with the tubing string, and plug means for removably blocking said chemical injection line down stream of said branch line.

14. An apparatus as defined by claim 13 wherein said plug means comprises a piston removably blocking said outlet from communication with said collection chamber, and a shear screw supporting said piston within said collection chamber and shearable upon pressurization of said injection line to a selected high pressure to shift said piston away from blocking said outlet.

15. An apparatus as defined by claim 13 wherein said retrieval means comprises a first shear screw yieldably connecting together said mandrel and said second setting heads, and a lifting shoulder abuttable between said mandrel and said first setting head after shearing of said first shear screw upon pulling of said tubing string to lift said first setting head from beneath said slips for unsetting of said slips.

16. An anchor for securing the lower end portion of a string of tubing to the casing in a well for recovery of fluid in the well using pump means, said anchor comprising:

a tubular mandrel with upper and lower connectors adapted for connection within the tubing string, a tubular anchor cage concentrically spaced around said mandrel and connected to one of said connectors, a plurality of slips angularly spaced from each other around said mandrel within said cage and being movable radially outward thereof to embed in the casing, first and second spaced setting heads connected to said mandrel between said connectors with said slips being disposed between said setting heads, said heads including axially spaced wedging surfaces.

a setting piston associated with said first setting head and located in the space between said anchor cage and said mandrel with a pressure chamber defined by the space on one side of piston and said chamber being sealed against communication with the inside of said mandrel, means sealing said pressure chamber normally against fluid communication with the inside of said mandrel, and a pressure passage communicating from said pressure chamber to the outside of said mandrel for connection to a pressure source outside of said well for pressurization of said presdure chamber for driving said piston to shift said first setting head toward the second and thereby wedge said slips outwardly for embedding in the casing.

17. A method for installation of well apparatus for chemical treatment of produced fluids comprises the steps of lowering a tubing anchor to a selected position in a well with a collection chamber for a pump at the lower end of the well tubing extending into the well fluid to be produced, connecting a chemical injection line to the side of the well tubing with an outlet of the injection line disposed within the collection chamber, temporarily blocking the outlet of chemical injection line, connecting the chemical injection line with a pressure chamber for setting slips of the tubing anchor above the blocked outlet of the chemical injection line, pumping a pressure fluid through said chemical injection line and said branch line to at least initially set said anchor slips, thereafter, unblocking said blocked outlet, and delivering an injection chemical through said injection line into the collection chamber to mix with the well fluid therein.

18. The method as set forth in claim 17 including the step of pulling on said tubing string after said slips have been at least initially set and without rotating the tubing string so as to completely set the slips.

* * * * *